United States Patent [19]

Jacobson et al.

[11] 4,171,849

[45] Oct. 23, 1979

[54] APPARATUS FOR CLEANING PAVEMENT EXPANSION JOINTS

[75] Inventors: Carl C. Jacobson, Tempe; Gaius P. Crosby, Mesa, both of Ariz.

[73] Assignee: Crafco, Inc., Phoenix, Ariz.

[21] Appl. No.: 943,663

[22] Filed: Sep. 18, 1978

[51] Int. Cl.[2] ..... E21C 47/00

[52] U.S. Cl. ..... 299/36; 404/89; 404/74; 404/87

[58] Field of Search ..... 404/89, 83, 74; 299/36, 299/37; 15/93 R

[56] References Cited

U.S. PATENT DOCUMENTS

| | | | |
|---|---|---|---|
| 615,698 | 12/1898 | Hardy | 404/89 X |
| 2,541,309 | 2/1951 | Trail | 299/36 |
| 2,584,993 | 2/1952 | Eder | 299/36 |
| 2,633,345 | 3/1953 | Nordone | 299/36 |
| 3,043,200 | 7/1962 | Huttash | 299/36 X |
| 3,432,969 | 3/1969 | Byttebier | 404/89 X |
| 3,791,696 | 2/1974 | Riley | 299/36 X |
| 3,904,245 | 9/1975 | Clarke | 299/37 |
| 4,043,601 | 8/1977 | Schiller | 299/36 |

FOREIGN PATENT DOCUMENTS

| | | | |
|---|---|---|---|
| 648169 | of 1950 | United Kingdom | 299/36 |

*Primary Examiner*—Nile C. Byers, Jr.
*Attorney, Agent, or Firm*—Herbert E. Haynes, Jr.

[57] ABSTRACT

An apparatus for removing sealants from expansion joints in pavement slabs preparatory to replacement of the sealant is adapted for demountable attachment to the rear of a motorized vehicle. The apparatus includes a frame which is pivotably movable about a horizontal axis by means of a linear actuator. A carriage, having a cutting tool bit carried in a tool holder at the trailing edge thereof, is supported on the frame so as to be pivotably movable therewith with such movement employed for positioning and holding the cutting tool in the joint being cleaned. The carriage is free to laterally slide relative to the frame for freely tracking the expansion joint being cleaned.

15 Claims, 6 Drawing Figures

APPARATUS FOR CLEANING PAVEMENT EXPANSION JOINTS

BACKGROUND OF THE INVENTION

1. Field of the Invention

This invention relates to pavement working machines, and more particularly to an apparatus for removing sealant materials from the expansion joints between pavement slabs prior to replacement of the sealant.

2. Description of the Prior Art

It has long been known that concrete slabs used for paving roadways, aircraft landing strips, the floors of buildings, and the like, must be provided with expansion joints at spaced intervals to allow expansion and contraction of the slabs resulting from ambient temperature deviations. Such expansion joints may be formed by the casting thereof simultaneously with pouring of the cement slabs, or may be cut therein after curing of the cement. Typically, such joints will be formed at about 25 foot intervals, will be about one to one and a half inches deep and will vary in width from three-eights of an inch to about one and one-half inches. These dimensions however, are only typical in that they may vary considerably.

In addition to expansion joints being used between adjacent slabs of concrete, expansion joints are often needed in other types of pavement. For example, a paved surface consisting of a concrete slab having an adjacent asphalt surface such as a concrete roadway having an asphalt shoulder strip. However, it is much more common that such joints are used in adjacent slabs of concrete, thus, the pavement will hereinafter be referred to as concrete.

It is also well known that the above described expansion joints must be filled with an elastomeric sealant to prevent the entry of foreign materials. If water is allowed to enter and pass downwardly through expansion joints, the concrete supporting bed may be washed away which can result in settling or cave-in of the cement slabs. If water is trapped in expansion joints during freezing weather, repturing of the concrete slabs can result. If noncompressible materials such as sand or dirt enter into the expansion joints, slab rupturing can occur upon expansion of the slab due to relatively warm ambient temperatures.

Various types of joint sealing materials have been used such as rubberized asphalt, coal tar extended polysulfide, polyurethane polymers, rubberized polyvinyl chloride, and the like. However, thermal expansion and contraction, exposure to the elements, spillage of gasoline and solvents and heavy loading of the concrete slabs will cause a gradual breakdown in the sealants which must be periodically removed and replaced to prevent damage to the concrete surface. The time interval between the necessary replacement of the sealants depends upon the nature of the sealants and the conditions to which it may be exposed. Some sealants will need to be replaced at intervals as short as two or three years, while others in less demanding environments will last up to ten years or more.

Regardless of the type of sealant used in an expansion joint and the environment, sealants must be periodically removed and replaced with the task of sealant removal being difficult and time consuming.

The most widely used type of apparatus for removing old sealants from expansion joints consists basically of an arm extending rearwardly from a suitable motorized vehicle such as a tractor. The arm is raised and lowered such as by hydraulics which are controlled from the vehicle and the arm is provided with a joint cleaning tool at its trailing end. The joint cleaning tool is lowered hydraulically, or otherwise, into the joint to be cleaned so that forward movement of the towing vehicle will pry or scrape the old sealant out of the joint. Examples of this basic type of prior art structure are fully set forth in U.S. Pat. Nos. 2,541,309, 2,584,993 and 3,043,200, and numerous problems have been encountered in connection with such mechanisms.

Removal of the old sealants from expansion joints in concrete slabs is very difficult due to the inherent nature of the material itself in that prying alone will leave a sealant residue on the side walls of the expansion joint, and proper bonding of the new sealant cannot be achieved. To overcome the sealant residue problem, the use of abrasive wheels, diamond saws and sand blasting all have been employed subsequent to prying the sealant out of the expansion joint. Such subsequent operations did not prove economically feasible in that they necessitated the transporting and use of additional equipment and manpower, thus the operational costs and time involved proved to be prohibitive.

Therefore, the above described prying and subsequent cleanup operations have, for the most part, been replaced with a single scraping or cutting operation in which the walls of the expansion joint are forcefully scraped so that a relatively thin layer of the concrete itself is cut away simultaneously with the removal of the old sealant. Such a single scraping, or cutting, operation will expose a clean residue free surface within the expansion joint so that proper bonding of the replacement sealant is easily accomplished. However, the single scraping or cutting operation requires that considerably larger forces be applied, as compared to the prying operation, and the prior art devices such as those disclosed in the above referenced U.S. patents were not designed for such use.

Another problem with these prior art devices was the difficulty experienced in keeping the joint cleaning tool, or bit, in the expansion joint as the towing vehicle moves along the joint. This tracking problem will be appreciated upon consideration that expansion joints, especially those that are cut after the concrete slab has cured, are not always perfectly linear, and it is extremely difficult to drive the motorized vehicle in a path that is perfectly straight and coincident with the expansion joint. For this reason, the above described prior art mechanisms employed some form of a pivot or swivel joint at the forward end of their trailing arms. With the rearwardly extending arm being capable of pivotable movement the arcuate path in which the joint cleaning tool bit was free to move was adequate as long as a prying type of operation was being employed, however, such movement of the tool bit in an arcuate path transverse to the expansion joint proved to be troublesome when the single scraping, or cutting, technique was employed. In removing the old sealant by a scraping or cutting operation, the joint cleaning tool bit must be provided with concrete cutting edges on opposite sides of the bit, and if the bit is allowed to assume a skewed attitude in the expansion joint as a result of pivotal movement of the trailing arm, unbalanced cutting forces will be applied. If the skewed position of the tooling bit is severe enough, one or the other of the concrete cutting edges may miss the side wall entirely and the bit will tend to crawl up the engaged side wall of the joint being cleaned and pull itself out of that joint.

In an attempt to overcome some of the above described problems, an improved expansion joint cleaning mechanism was devised and that mechanism is fully disclosed in U.S. Pat. No. 3,791,696. Briefly, this specific prior art mechanism includes a substantially square frame upon which a pantograph-like swing arm is carried, with the swing arm having a joint cleaning tool bit on the trailing end thereof. The pantograph-like swing arm includes two pair of spaced apart upper and lower plates which are pivotably connected to the forward crossbar of the frame and extend rearwardly therefrom in cantilever fashion so as to straddlingly pass above and below the rear cross member of the frame. A bar is pivotably connected between the rearwardly disposed ends of the plates and a tool holder, for mounting of the tool bit, is carried on the bar. The frame is pivotably coupled at its forward end to the rear of the motorized vehicle so as to be pivotably movable about a horizontal axis. This pivot movement, which is employed to raise and lower the trailing edge of the mechanism relative to the joint, is accomplished by means of a hydraulic cylinder that is connected between the vehicle and the frame. This pivot movement of the frame is transmitted through the rear crossbar of the frame to the swing arm plates, so that the swing arm will forcefully hold the tool bit in the joint being cleaned.

This briefly described specific prior art joint cleaning mechanism is a substantial improvement over preceding mechanisms; however, some problems still exist. In the first place, the hydraulic cylinder employed to move the device is connected to one of the corners of the frame which is at the forward end of the frame adjacent the pivot connection thereof to the vehicle. Connection of the hydraulic cylinder at that point of the frame is inherently poor design in that the downwardly applied force necessary to hold the tool bit in the joint is at the opposite end of the frame and is applied in an off-center position. Thus, the frame must be very heavy structurally, so that deflection and twisting forces will not distort the frame. Secondly, although the pantograph-like swing arm will maintain the desired nonskewed position of the tool bit in the expansion joint, the swing arm will inherently try to straighten itself into a perfect square, or rectangle, when being pulled by the vehicle. This tendency for self-straightening of the swing arm, coupled with the fact the pulling forces exerted by the vehicle can, and very often are, being applied at an angle relative to the path of the expansion joint, i.e., not coincident therewith, results in uneven application of the pulling forces and results in an unbalanced cutting pressure being applied to the side walls of the expansion joint. In the event that the angular relationship between the pulling forces applied by the vehicle, and the path of the joint becomes excessively large, gouging and chipping of the side walls of the joint may result, and in some instances, the tool bit may be pulled completely out of the joint.

Therefore, a need exists for a new and improved mechanism for removing old sealant material from the expansion joints between concrete slabs with the new and improved mechanism overcoming some of the problems and shortcomings of the prior art.

SUMMARY OF THE INVENTION

In accordance with the present invention, a new and improved apparatus for cleaning concrete expansion joints preparatory to replacement of the joint sealant is disclosed. The apparatus includes a frame which is demountably pivotably coupled to the rear of a motorized towing vehicle so as to extend rearwardly therefrom, and is pivotably movable about a horizontal axis which passes through the pivot coupling. The frame includes a spaced pair of side plates with spaced front and rear crossbars. Pivot movement of the frame is accomplished by a linear actuator, which is preferably electric, and which is controlled from the vehicle and is mounted between the vehicle and a central point on the rear crossbar. A rigid carriage is mounted on the frame so as to be free for laterally slidable movement in a path which is transverse to the path of the expansion joint being cleaned, and the carriage has a tool holder in which a joint cleaning tool bit means is demountably carried, with the tool holder being located centrally at the rear or trailing edge of the carriage.

Pivotal movement of the frame by means of the linear actuator is employed to raise and lower the rearwardly disposed trailing end of the apparatus from its nonworking position where the tool bit means is disposed above the surface of the concrete, and its working position where the tool bit means is in the expansion joint. When the apparatus is in its working position, the tool bit means will be held in the expansion joint by the linear actuator. Since the downward force which holds the tool bit means in the joint is applied centrally of the trailing edge of the frame, and the tool bit means is in that same area as a result of its being mounted centrally at the trailing edge of the carriage, that force is exerted in the immediate area where it is needed, and the frame can be a relatively light structural element in that it will not be subjected to deflective and twisting forces.

The free lateral sliding capability of the carriage relative to the frame allows the carriage to floatingly track the expansion joint when the motorized vehicle is moving so that the tool bit will be maintained in a nonskewed attitude regardless of irregularities in the linear path of the expansion joint or misalignment between the path of the moving vehicle and the path of the expansion joint. This same lateral sliding capability of the carriage insures that the pulling forces exerted by the motorized vehicle will be applied to the tool bit in a straight line which lies along and is coextending with the path of the expansion joint regardless of vehicle and joint misalignments.

The tool bit holder employed on the joint cleaning apparatus of the present invention is adjustable so that the inclination of the tool bit means can be altered in accordance with differing job requirements. Further, the holder is designed to accommodate tool bit means of different widths so that expansion joints of different widths can be cleaned, and the holder is designed to facilitate removal and replacement of the tool bit means.

As hereinbefore mentioned, the linear actuator is preferably electric in that such a device is extremely simple to connect into the existing electrical system of any suitable motorized vehicle. This simplified hookup, in conjunction with the demountability of the apparatus of the present invention, substantially reduces the costs involved in that the motorized vehicle need not be equipped with a hydraulic system and need not be limited to this highly specialized use in that the vehicle can be used for other purposes by simply removing the apparatus. Further, since the frame of the present apparatus is relatively light in comparison to the prior art structure, it is therefore easy to handle and less expensive to fabricate.

Accordingly, it is an object of the present invention to provide a new and improved apparatus for cleaning pavement expansion joints.

Another object of the present invention is to provide a new and improved apparatus for cleaning pavement expansion joints, with the apparatus being adapted for demountable coupling to the rear of a motorized towing vehicle.

Another object of the present invention is to provide a new and improved apparatus for cleaning pavement expansion joints with the apparatus being relatively light in weight and relatively inexpensive to fabricate.

Another object of the present invention is to provide a new and improved apparatus for cleaning concrete expansion joints, with the joint cutting and scraping forces applied by the apparatus being exerted equally on the opposite side walls of the joint being cleaned thereby.

Another object of the present invention is to provide a new and improved apparatus for cleaning the expansion joints in concrete with the apparatus being adapted to freely track the expansion joint being cleaned, with this free tracking capability nullifying the angular forces which would otherwise be exerted thereon as a result of irregularities in the linear path of the joint, and misalignments of the vehicle's travel path with the path of the joint.

Another object of the present invention is to provide a new and improved apparatus for cleaning of the expansion joints in concrete, which includes a frame pivotably coupled to the rear of a towing vehicle so as to be pivotably movable about a horizontal axis which passes through the pivot coupling, with such pivot movement being accomplished by a linear actuator that is connected centrally to the trailing edge of the frame.

Another object of the present invention is to provide a new and improved apparatus of the above described character which further includes a rigid carriage freely laterally slidable on the frame thereof in a linear path transverse to the length of the expansion joint being cleaned so that a joint cleaning tool bit carried centrally on the trailing edge of the carriage will freely track the expansion joint in a linear tracking path which is transverse to the path of the expansion joint.

Still another object of the present invention is to provide an apparatus of the above described character in which the trailing edge of the carriage is in the immediate vicinity of the trailing edge of the frame so that the force exerted by the linear actuator on the frame will be directly transmitted to the joint cleaning tool bit for holding thereof within the joint being cleaned.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
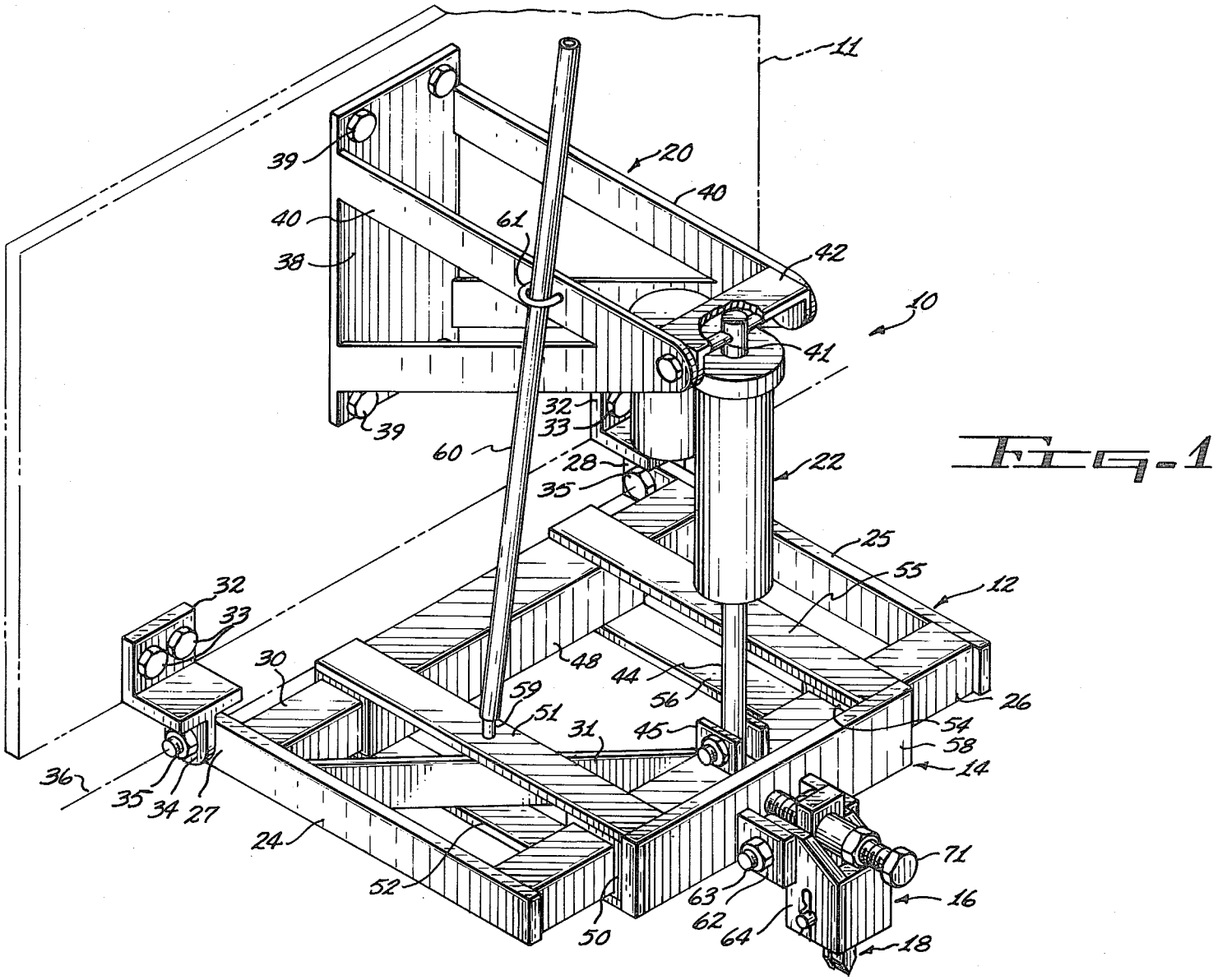
FIG. 1 is an isometric view of the concrete expansion joint cleaning apparatus of the present invention illustrating the various features thereof.

Referring more particularly to the drawings, FIG. 1 best illustrates the pavement expansion joint cleaning apparatus of the present invention which is indicated generally by the reference numeral 10. The apparatus 10 is designed to be demountably attached to a vertical backboard 11 which is fixed to the rear of a suitable motorized vehicle (not shown) so that the apparatus extends rearwardly from the vehicle and will be pulled, or towed thereby when the vehicle is driven. It will be understood that mounting of the apparatus 10 on the backboard 11 is the preferred mounting method but that mounting thereof could be otherwise accomplished, such as to the vehicle's frame (not shown) without effecting the operation or functioning of the apparatus.

As will hereinafter be described in detail, the apparatus 10 includes a frame 12 which is pivotably attached to the backboard 11 with a rigid carriage 14 slidably carried on the frame. The carriage has a tool holder 16 mounted centrally thereon at its trailing edge, with the tool holder providing means for adjustably demountably affixing a tool bit means 18 to the carriage. Further, the apparatus 10 includes a bracket 20 which extends rearwardly from the backboard 11 for suspendingly supporting a linear actuator means 22 from its extending end, with the linear actuator means being coupled centrally to the trailing edge of the frame 12 for pivotable movement of the frame.

Figure 3:
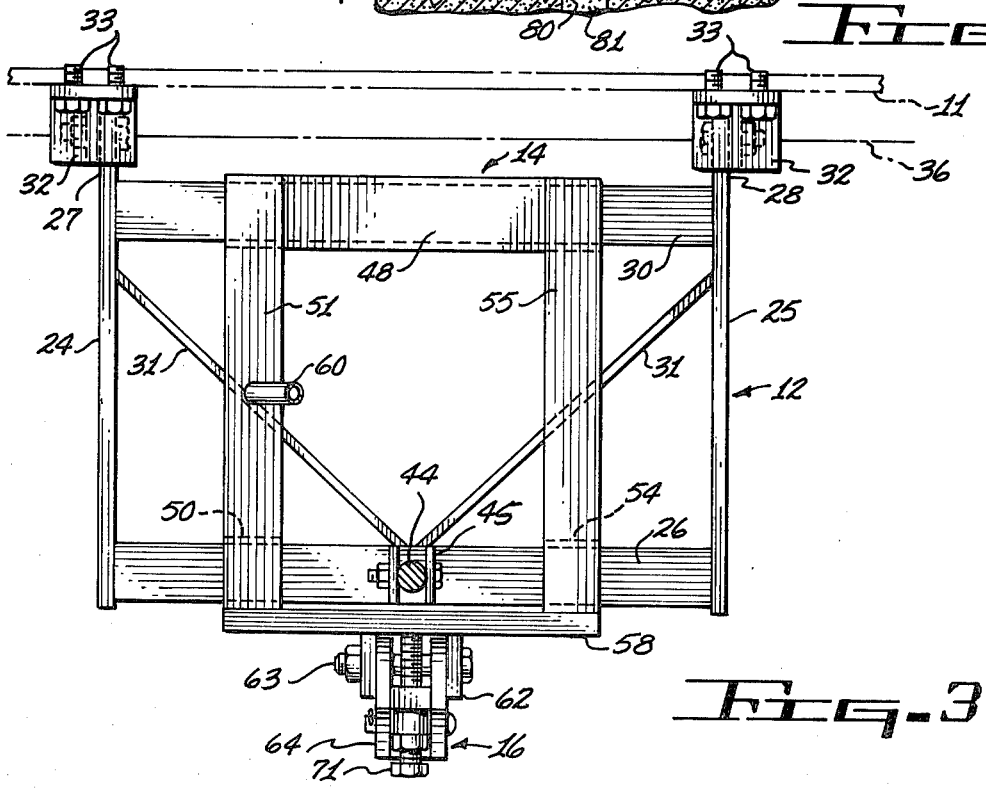
FIG. 3 is a sectional view taken along the line 3—3 of FIG. 2.

The frame 12 is fabricated with a spaced apart pair of side rails 24 and 25 which are interconnected at their rearwardly disposed aligned ends by a rear or trailing edge crossbar 26 which is preferably square in cross section, and are interconnected immediately inboard, or rearwardly, of the aligned front ends 27 and 28 by a front or leading edge crossbar 30 which is also preferably square in cross section. The frame 12 is provided with a pair of struts 31, which as seen best in FIG. 3, are affixed to different ones of the side rails 24 and 25 and converge rearwardly and are affixed to the trailing edge crossbar 26 centrally thereof, with those struts serving as braces to rigidify the frame.

The front ends 27 and 28 of the side rails 24 and 25 respectively, of the frame 12, extend forwardly of the leading edge crossbar 30, due to the inboard disposition thereof and serve as mounting lugs by which the frame is pivotably coupled to a spaced pair of angle brackets 32 carried on the bottom edge of the backboard 11. Each of the angle brackets 32 has an upstanding flange which is affixed to the backboard 11, such as with suitable bolts 33, and a rearwardly extending flange from which a lug 34 depends. The front ends, or lugs 27 and 28 of the frame 12 are each pivotably connected to a different one of the depending lugs 34 of the angle brackets 32 with suitable pivot bolts 35. It will be noted that the pivot bolts 35 are in alignment with each other and form a horizontal axis 36 about which the frame is pivotably movable as will hereinafter be described in detail.

The bracket 20 includes a flat plate 38 which is demountably attached to the backboard 11, such as by bolts 39, with the bracket mounted centrally on the backboard and spaced above the frame 12. A pair of spaced apart arms 40 extend rearwardly from the plate 38 and have their free ends interconnected by a transverse pin 41 and an inverted spanner channel 42 which serves to rigidity those free ends.

The linear actuator means 22, which in the preferred embodiment is an electromechanical device due to the simplicity of connecting such a device into the existing electrical system of any suitable motorized vehicle (not shown), is pivotably connected at its upper end to the transverse pin 41 of the bracket 20. The actuator 22 depends from the pin 41 and has its output shaft 44 pivotably attached to a suitable upstanding clevis 45 fixedly carried intermediate the opposite ends of the trailing edge crossbar 26 of the frame 12. It will now be seen that when the linear actuator 22 is actuated, it will pivotably move the frame 12 about the horizontal axis 36, which results in raising or lowering of the trailing edge crossbar 26 relative to a paved concrete surface 46.

Figure 4:
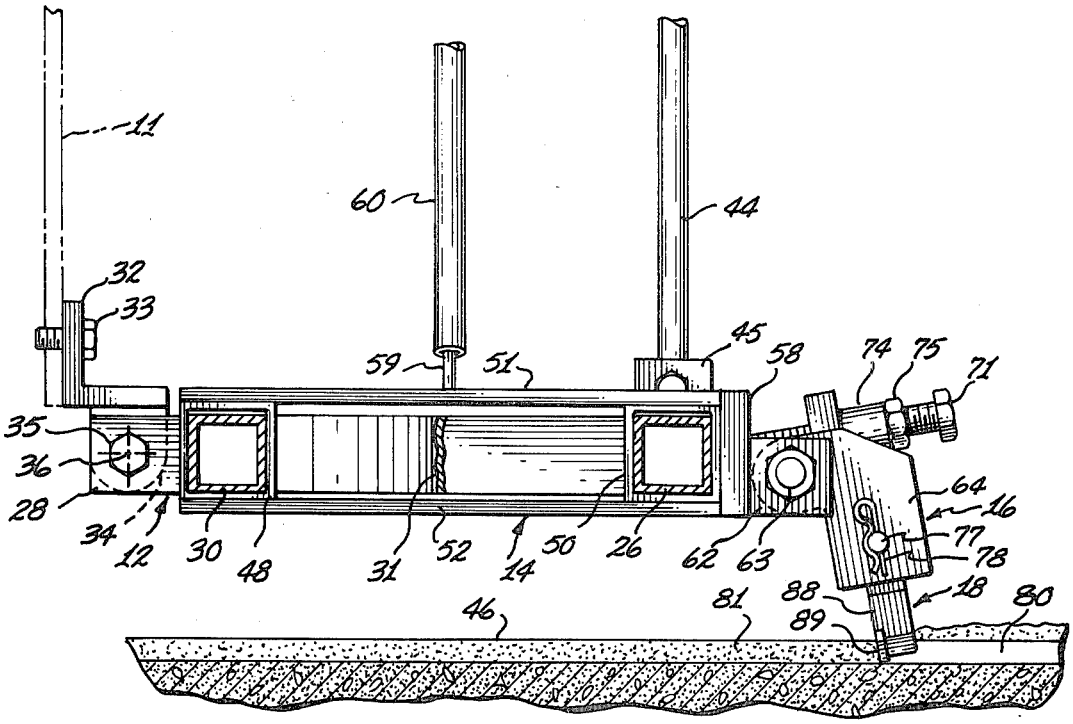
FIG. 4 is a sectional view taken along the line 4—4 of FIG. 2.

The rigid carriage 14, as seen best in FIGS. 1, 3 and 4, includes an elongated forwardly disposed tubular member or sleeve 48 which is preferably square in cross section and is carried on the leading edge crossbar 30 of the frame and is free to slidably move along the length thereof between the frame's side rails 24 and 25. A first relatively short tubular member or sleeve 50, which is preferably square in cross section, is aligned with one end of the sleeve 48 and is connected thereto by a flat upper side rail 51 which has its opposite ends suitably affixed such as by welding to the top surfaces of the sleeves 48 and 50, and a flat lower side rail 52 which is also affixed on its opposite ends to the bottom surfaces of the sleeves 48 and 50. Similarly, a second relatively short tubular member or sleeve 54, which is also preferably of square cross section, is aligned with the opposite end of the sleeve 48 and is connected thereto by a flat upper side rail 55 which is affixed on its opposite ends to the top surfaces of the sleeves 48 and 54, and a flat lower side rail 56 which is affixed on its opposite ends to the bottom surfaces of those sleeves. The relatively short sleeves 50 and 54 are disposed rearwardly of the elongated sleeve 48 and are carried on the trailing edge crossbar 26 of the frame 12 and are free to slidably move along the length thereof. A vertically disposed cross plate 58 is affixed to the rearmost vertical surfaces of the relatively short sleeves 50 and 54 for rigidly interconnecting those sleeves, and to provide means for supporting the tool holder 16 as will hereinafter be described in detail.

As hereinbefore mentioned, it is preferred that the trailing edge crossbar 26 and the leading edge crossbar 30 of the frame 12 be of square cross section, and that the sleeves 48, 50 and 54 are also square in cross section. Such configurations are preferred for load distribution purposes, which will become apparent as this description progresses, but it will be understood that other cross sectional configurations could be employed such as round, hexagonal, and the like. As seen in FIG. 4, the fit of the trailing edge crossbar 26 in the sleeves 50 and 54 is loose, and a similar loose fit is provided between the leading edge crossbar 30 and the sleeve 48. These loose fits are provided for lubrication purposes so that when in operation, a suitable grease may be periodically applied to the crossbars 26 and 30 to insure a free sliding movement of the carriage on the frame 12. Since the apparatus 10 is designed to be employed in a relatively dusty and dirty environment, the loose fit of the crossbars 26 and 30 within the sleeves 48, 50 and 54 will facilitate periodic cleaning of contaminants which would interfere with the free sliding movements of the carriage on the frame.

An upstanding peg 59 is affixed to the upper surface of the upper flat side rail 51 of the carriage 14, and an elongated tubular rod 60 is positioned so that its open depending end loosely slides over the peg. The rod extends upwardly from the peg and passes through a bale-shaped fulcrum 61 which is suitably affixed to the bracket 20. The upper end of the tubular rod 60 serves as a handle so that an operator of the motorized vehicle (not shown) to which the apparatus is attached, may grasp the handle and manually manipulate the carriage for alignment of the tool bit means 18 with an expansion joint prior to cleaning thereof, as will hereinafter be described in detail.

The cross plate 58 carried at the trailing edge of the carriage 14, has a rearwardly extending clevis 62 affixed centrally thereto, with the clevis having a bolt 63 by which the tool holder 16 is connected to the trailing edge of the carriage for pivotable movement about a horizontal axis extending longitudinally of the bolt. As seen best in FIGS. 5 and 6, the tool holder 16 includes a housing body 64 having a bore 65 formed therethrough. The body 64 includes spaced side walls 66 each of which have an ear extending normally from the upwardly disposed end thereof, with those ears serving as means for attaching the tool holder 16 to the pivot bolt 63 carried in the clevis 62. The body 64 has opposed end walls 68 and 69 with the end wall 69 extending upwardly beyond the top edge of the end wall 68. The upwardly extending portion of the end wall 69 has a threaded bore 70 formed therethrough in which a bolt 71 is threadingly carried. The bolt 71 is disposed so that the end of its threaded shank 72 is in abutting engagement with the cross plate 78 so that the bolt serves as an adjustable stop for setting the pivoted position of the housing body 64 as will hereinafter be described. The headed end of the bolt 71 extends from the bore 70 of the end wall 69 through a smooth bore spacer sleeve 74 so that a jam nut 75 which is carried on a threaded shank 72, will seat against the sleeve when the nut is tightened to lock the bolt 71 in the desired position. By utilizing the sleeve 74, in conjunction with the bevelled corners 75 formed on each of the side walls 66, the jam nut 75 is positioned in spaced relationship from the end wall 69 and is thus disposed for easy access to facilitate adjustment of the tool holder 16 to various positions as indicated in phantom lines in FIG. 5. Each of the opposed side walls 66 of the housing body 64 is provided with an aperture 76 formed therethrough with those apertures being aligned to demountably receive a headed pin 77. The pin 77 passes transversely through the bore 65 and is retained by a clevis pin 68 which is demountably engageable with the extending end of the pin 77. As will hereinafter be described, the pin 77 is employed for attaching the tool bit means 18 to the tool bit holder 16.

Figure 2:
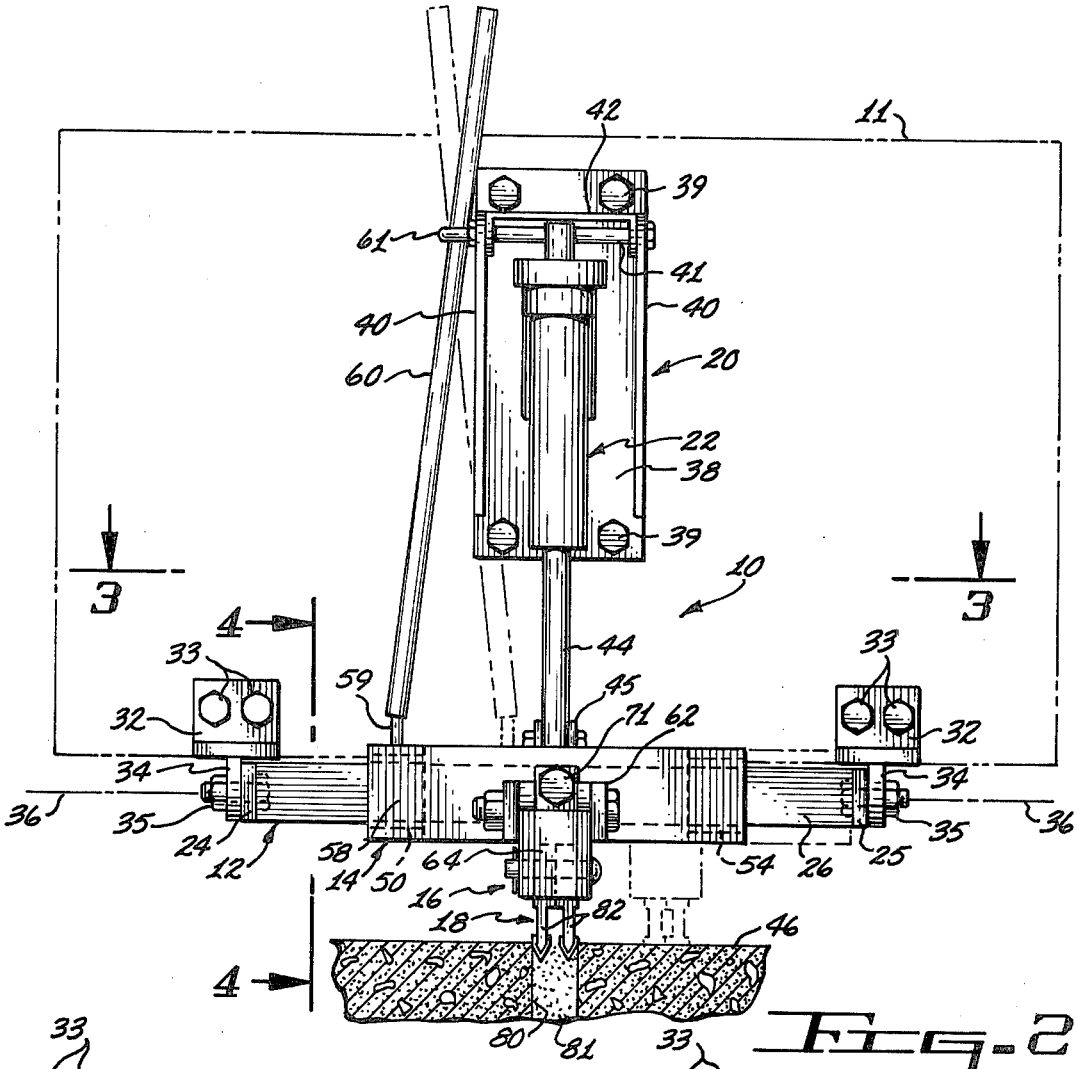
FIG. 2 is a rear elevational view of the concrete expansion joint cleaning apparatus of the present invention.

A typical expansion joint as shown in FIG. 2, is formed between adjacent slabs in the concrete or other paved surface 46 and includes a groove or slot 80 which may be formed concurrently with pouring of the concrete, or may be cut therein after the cement is cured, and in either case, the groove 80 is subsequently filled with a suitable elastomeric sealant 81. Due to the different ways that expansion joints are formed, and due to the possibility that older joints may have been enlarged by previous cleanings, such joints can have width dimensions as small as three-eights of an inch, or as large as one and one-half inches. Therefore, the bore 65 provided in the tool holder 16 is sized to accept tool bit means of various sizes and in various combinations. For example, the tool bit means 18 shown in FIG. 2 includes a pair of bits 82 disposed in side by side relationship with this arrangement being ideally suited to simultaneously cut the cement which forms the side walls of a joint having a relatively large width dimension, with such cutting action dislodging the old sealant 81 and producing clean cement side walls to which new sealants will readily bond. It will be noted that in the combination bit arrangement described above, a gap exists between the side by side bits 82 which will, of course, leave a central ridge of old sealant material and will leave the bottom of the joint with old sealant therein. The old sealant at the bottom of the joint and the material forming the central ridge may be removed in a subsequent joint cleaning operation in which a single joint cleaning tool bit means (not shown) of different configuration is employed in the apparatus 10 of the present invention.

Figure 5:
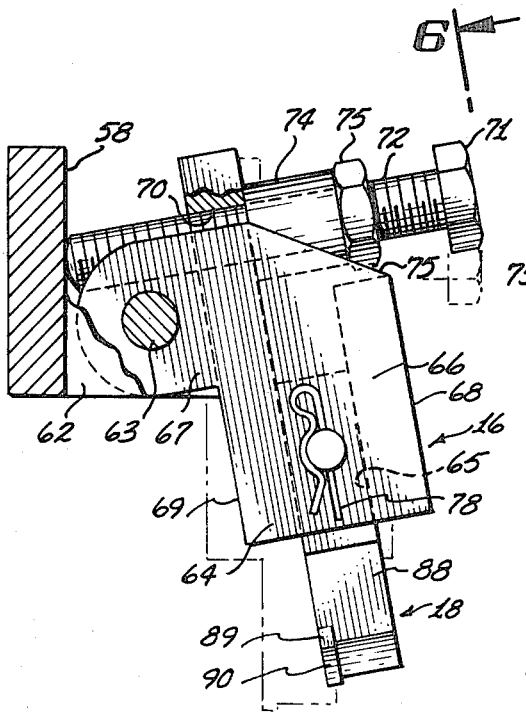
FIG. 5 is an enlarged fragmentary sectional view illustrating the side of a tool holder and tool bit means which form part of the apparatus of the present invention.
Figure 6:
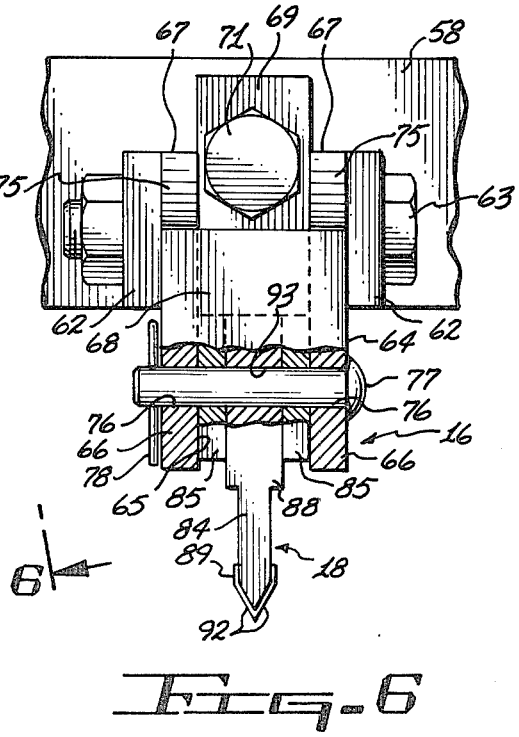
FIG. 6 is a rear elevational view of the tool holder and tool bit means shown in FIG. 5 with portions thereof being broken away to illustrate the various features thereof.

In cleaning an expansion joint having a relatively small width dimension, a tool bit mounting arrangement such as that shown in FIGS. 5 and 6 may be employed. In this mounting arrangement, a tool bit 84 is positioned in the bore 65 of the tool holder 16, with a spacer 85 being provided on each of the opposite sides of the tool bit.

It should now be apparent that various types and combinations of tool bit means will be needed to properly clean the various expansion joints, and that the tool holder 16 is designed to accommodate such varieties.

The tool bit 84 illustrated in FIGS. 5 and 6 is typical and, is shown as including a shank portion 88 with a concrete cutting tooth 89 provided on its depending end. The cutting tooth is formed of a suitable material, such as tungsten carbide, and is configured with a flat face 90 having bevelled cutting edges 92 on each of its opposite sides. The shank portion 88 of the tool bit 84 is provided with an aperture 93 through which the tool bit mounting pin 77 of the tool holder 16 passes for demountably retaining the tool bit in the holder, and in this particular illustrated mounting arrangement, each of the spacers 85 is also provided with a suitable aperture.

In view of the above detailed description, it is believed that the operation and function of the apparatus 10 of the present invention is readily apparent. However, the following operational description is given to insure a clear understanding thereof.

When a particular job sight has been reviewed to ascertain the proper tool bit means 18 for the job, and to determine the proper inclination setting of the tool holder 16, the motorized vehicle (not shown) is positioned so that its wheels straddle the expansion joint to be cleaned. The vehicle's operator then slidably moves the carriage 14 on the frame 12, by manual manipulation of the elongated rod 60 to locate the tool bit means 18 immediately above the expansion joint, and then the linear actuator 22 is employed to move the tool bit means into the joint.

With the apparatus 10 thus moved into its working position, the expansion joint is cleaned preparatory to replacement of the old sealant by simply driving the motorized vehicle (not shown) along the length of the expansion joint.

The freely slidable movement capability of the carriage 14 on the frame 12, as hereinbefore described, will apply the pulling forces exerted by the motorized vehicle to the tool bit means 18 in a straight line that is coincident with the path of the joint being cleaned in that any deviations in the linear path of the joint, or misalignment of the path of the vehicle with respect to the path of the joint, will be compensated for by repositioning of the carriage 14.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What we claim is:

1. An apparatus for cleaning expansion joints between adjacent slabs of pavement comprising:

(a) a frame having a leading edge and a trailing edge;

(b) means for pivotably coupling said frame to the rear of a motorized vehicle, said means being adjacent the leading edge of said frame and defining a horizontal pivot axis;

(c) a linear actuator means coupled on one end thereof centrally to the trailing edge of said frame for pivotally moving said frame about its horizontal pivot axis;

(d) means for coupling the other end of said linear actuator means to the rear of the motorized vehicle;

(e) a rigid carriage having a leading edge mounted on the leading edge of said frame for free sliding movement therealong and having a trailing edge mounted on the trailing edge of said frame for free sliding movement therealong, the leading and trailing edges of said carriage rigidly interconnected;

(f) tool holder means mounted centrally on the trailing edge of said carriage; and (g) tool bit means demountably carried in said tool holder means for insertion into the expansion joint to be cleaned.

2. An apparatus as claimed in claim 1 wherein said frame comprises:

(a) a pair of horizontally spaced parallel side rails;

(b) a rear crossbar transversely affixed between first ends of said pair of side rails and forming the trailing edge of said frame; and (c) a front crossbar transversely affixed between second ends of said pair of side rails and forming the leading edge of said frame.

3. An apparatus as claimed in claim 2 wherein said rear crossbar and said front crossbar are of substantially square cross section.

4. An apparatus as claimed in claim 2 wherein said front crossbar is disposed immediately inboard of the second ends of said pair of side rails so that those second ends extend beyond said front crossbar for pivotal attachment to said means for pivotably coupling said frame to the rear of a motorized vehicle.

5. An apparatus as claimed in claim 1 wherein said means for pivotably coupling said frame to the rear of a motorized vehicle comprises a pair of angle brackets for horizontally spaced demountable attachment to the rear of the motorized vehicle, each of said pair of angle brackets having a depending lug to which said frame is pivotably coupled.

6. An apparatus as claimed in claim 1 wherein said rigid carriage comprises:

(a) an elongated tubular member slidably mounted on the leading edge of said frame;

(b) a first relatively short tubular member slidably mounted on the trailing edge of said frame and aligned with one end of said elongated tubular member;

(c) a second relatively short tubular member slidably mounted on the trailing edge of said frame and aligned with the other end of said elongated tubular member;

(d) side rail means for rigidly connecting said first relatively short tubular member to said elongated tubular member and for rigidly connecting said second relatively short tubular member to said elongated tubular member; and (e) cross plate means rigidly interconnecting said first and said second relatively short tubular members.

7. An apparatus as claimed in claim 6 wherein said elongated tubular member and said first and said second relatively short tubular members are substantially square in cross section.

8. An apparatus as claimed in claim 1 wherein said rigid carriage comprises:

(a) an elongated tubular member slidably mounted on the leading edge of said frame and forming the leading edge of said carriage;

(b) a first relatively short tubular member slidably mounted on the trailing edge of said frame and in alignment with one end of said elongated tubular member;

(c) a second relatively short tubular member slidably mounted on the trailing edge of said frame and in alignment with the other end of said elongated tubular member;

(d) a first pair of vertically spaced flat side rails rigidly interconnecting said first relatively short tubular member to the one end of said elongated tubular member;

(e) a second pair of vertically spaced flat side rails rigidly interconnecting said second relatively short tubular member to the other end of said elongated tubular member;

(f) a vertically disposed cross plate transversely affixed between said first and said second relatively short tubular members; and (g) said first and said second relatively short tubular members and said vertically disposed cross plate forming the trailing edge to which said tool holder means is mounted.

9. An apparatus as claimed in claim 1 wherein said linear actuator means is an electromechanical mechanism.

10. An apparatus as claimed in claim 1 wherein said means for coupling the other end of said linear actuator means to the rear of the motorized vehicle comprises a bracket for demountable connection to the rear of the motorized vehicle at a location above said frame and configured to extend from the vehicle to provide an extending end which is disposed in vertically spaced substantially aligned relationship with respect to the central portion of the trailing edge of said frame.

11. An apparatus as claimed in claim 1 wherein said means for coupling the other end of said linear actuator means to the rear of the motorized vehicle comprises:

(a) a plate for demountable attachment to the rear of the motorized vehicle at a location above said frame;

(b) a pair of horizontally spaced arms extending in parallel relationship from said plate and having free ends which are located in substantial alignment with the central portion of the trailing edge of said frame when said plate and said frame are mounted on the rear of the motorized vehicle;

(c) means for rigidly interconnecting said pair of arms at the free ends thereof; and (d) pivot pin means transversely extending between the free ends of said pair of arms from which the other end of said linear actuator means is pivotably suspended.

12. An apparatus as claimed in claim 1 wherein said tool holder means is pivotably coupled to the trailing edge of said rigid carriage for movement about a horizontal axis to adjustably position said tool holder means relative to the surface of the adjacent slabs of pavement.

13. An apparatus as claimed in claim 1 wherein said tool holder means comprises:

(a) a body having an elongated bore formed therein;

(b) means for demountably holding said tool bit means in the bore of said body;

(c) said body pivotably coupled to the trailing edge of said rigid carriage for movement about a horizontal axis with that movement being employed to adjust the angular relationship of the longitudinal axis of the bore of said body with respect to the surface of the adjacent slabs of pavement; and (d) stop means adjustably carried in said body and extending therefrom into abutting engagement with the trailing edge of said carriage for adjustably setting the pivoted position of said body.

14. An apparatus as claimed in claim 1 and further comprising manipulation means connected to said rigid carriage and to said means for coupling the other end of said linear actuator means to the rear of the motorized vehicle, said manipulation means for manually slidingly moving said rigid carriage on said frame.

15. An apparatus as claimed in claim 14 wherein said manipulation means comprises:

(a) a peg mounted on said rigid carriage and extending upwardly therefrom;

(b) an elongated tubular rod having its lower end loosely slidingly positioned on said peg;

(c) a fulcrum on said means for coupling the other end of said linear actuator means to the rear of the motorized vehicle, said fulcrum loosely circumscribing said elongated rod intermediate its opposite ends.

* * * * *